US010980087B2

(12) United States Patent
Norte

(10) Patent No.: US 10,980,087 B2
(45) Date of Patent: Apr. 13, 2021

(54) MICROWAVE COUPLER WITH INTEGRATED MICROWAVE SHIELD

(71) Applicant: Andrew David Norte, Westminster, CO (US)

(72) Inventor: Andrew David Norte, Westminster, CO (US)

(73) Assignee: Ricoh Company, Ltd., Tokyo (JP)

( * ) Notice: Subject to any disclaimer, the term of this patent is extended or adjusted under 35 U.S.C. 154(b) by 381 days.

(21) Appl. No.: 15/720,868

(22) Filed: Sep. 29, 2017

(65) Prior Publication Data

US 2019/0104574 A1 Apr. 4, 2019

(51) Int. Cl.

*H05B 6/64* (2006.01)
*H05B 6/70* (2006.01)
*H05B 6/80* (2006.01)

(52) U.S. Cl.

CPC ..... *H05B 6/6426* (2013.01); *H05B 6/701* (2013.01); *H05B 6/707* (2013.01); *H05B 6/80* (2013.01); *H05B 2206/046* (2013.01)

(58) Field of Classification Search

CPC ..... B41J 11/002; B41J 13/009; H05B 6/6426; H05B 6/701; H05B 6/707; H05B 6/78; H05B 6/80

USPC ..... 219/678, 690, 691–693, 736, 737, 738, 219/756, 762

See application file for complete search history.

(56) References Cited

U.S. PATENT DOCUMENTS

| | | | | |
|---|---|---|---|---|
| 4,401,873 | A * | 8/1983 | Berggren | H05B 6/701 219/693 |
| 4,889,966 | A * | 12/1989 | Meredith | H05B 6/6402 219/684 |
| 5,635,143 | A | 6/1997 | White et al. | |
| 6,075,232 | A | 6/2000 | Joines et al. | |
| 6,265,703 | B1 | 7/2001 | Alton | |
| 7,048,825 | B2 * | 5/2006 | Churchland | B27N 3/18 156/272.2 |
| 7,470,876 | B2 | 12/2008 | Drozd et al. | |
| 8,299,408 | B2 * | 10/2012 | Kimrey, Jr. | F26B 3/347 219/690 |
| 2010/0270291 | A1 * | 10/2010 | Kotzian | H05B 6/701 219/690 |
| 2015/0144620 | A1 * | 5/2015 | Wilber | H05B 6/701 219/694 |
| 2016/0050722 | A1 | 2/2016 | Fu et al. | |

* cited by examiner

*Primary Examiner* — Justin C Dodson
(74) *Attorney, Agent, or Firm* — Duft & Bornsen, PC

(57) ABSTRACT

Embodiments described herein provide a microwave coupler that utilizes a microwave shield within an interior of the microwave coupler to mitigate Radio Frequency (RF) leakage from an end of the microwave coupler. The microwave coupler includes a ramp section that is configured to mate to a microwave source, with the ramp section extending from an opening in a top wall of an enclosure. One end of the enclosure is configured to mate to a microwave waveguide, while an opposing end may be open or partially open. The microwave shield is located between the opposing end of the enclosure and the opening in the top wall, and extends from the top wall of the enclosure towards a bottom wall of the enclosure.

17 Claims, 9 Drawing Sheets

MICROWAVE COUPLER WITH INTEGRATED MICROWAVE SHIELD

FIELD

This disclosure relates to the field of microwave drying, and in particular, to microwave couplers that electromagnetically couple a microwave source to a microwave waveguide.

BACKGROUND

A microwave dryer utilizes microwave energy to heat a material applied to a medium, thereby fixing the material to the medium. In the microwave dryer, a microwave coupler is attached to a waveguide, and a microwave source attached to the microwave coupler directs microwave energy down a long axis of the waveguide. A passageway through the microwave coupler and the waveguide is sized to enable the medium to pass through the microwave coupler and the waveguide. As the medium traverses the passageway through the microwave coupler and the waveguide, the material applied to the medium is exposed to the microwave energy and is heated, thereby fixing the material to the medium. Since a passageway exists in the microwave coupler that allows the medium to traverse through the microwave coupler, RF energy injected into the microwave coupler can leak from the end of the microwave coupler where the medium enters the microwave coupler. The RF energy that leaks from the end is not available to provide heating to the material on the medium, which reduces the efficiency of the microwave dryer.

SUMMARY

Embodiments described herein provide a microwave coupler that utilizes a microwave shield within an interior of the microwave coupler to mitigate Radio Frequency (RF) leakage from an end of the microwave coupler. The microwave coupler includes a ramp section that is configured to mate to a microwave source, with the ramp section extending from an opening in a top wall of an enclosure. One end of the enclosure is configured to mate to a microwave waveguide, while an opposing end may be open or partially open. The microwave shield is located between the opposing end of the enclosure and the opening in the top wall, and extends from the top wall of the enclosure towards a bottom wall of the enclosure.

In one embodiment, a microwave coupler includes an enclosure, a ramp section, and a microwave shield. The enclosure includes a first end, a second end opposite the first end that mates to a microwave waveguide, a top wall between the first end and the second end, a bottom wall opposite the top wall between the first end and the second end, and side walls between the top wall and the bottom wall. The ramp section extends from an opening in the top wall and has a third end that mates to a microwave source. The ramp section directs microwave energy from the microwave source into an interior of the enclosure through the opening. The microwave shield is disposed between the first end and the opening and extends from the top wall towards the bottom wall.

Another embodiment comprises a microwave dryer that fixes a material applied to a medium. The microwave dryer includes a microwave coupler, a microwave source, and a microwave waveguide. The microwave coupler has an enclosure that includes a first end, a second end opposite the first end, a top wall between the first end and the second end, a bottom wall opposite the top wall between the first end and the second end, and side walls between the top wall and the bottom wall, wherein the enclosure includes a first passageway that receives the medium at the first end and is sized to pass the medium through the enclosure. The microwave coupler further includes a ramp section extending from an opening in the top wall, and a third end. The microwave shield is disposed between the first end and the opening, and extends from the top wall towards the bottom wall. The microwave source is coupled to the third end and generates electromagnetic energy to fix the material to the medium. The microwave waveguide is coupled to the second end and transports the electromagnetic energy received from the microwave coupler. The microwave waveguide includes a second passageway that receives the medium from the first passageway and is sized to pass the medium through the microwave waveguide.

Another embodiment comprises a printing system. The printing system includes a print engine and a microwave dryer. The print engine applies a wet colorant to a print medium. The microwave dryer receives the print medium from the print engine, and dries the wet colorant applied to the print medium. The microwave dryer includes a microwave coupler, a microwave source, and a microwave waveguide. The microwave coupler includes an enclosure having a first end, a second end opposite the first end, a top wall between the first end and the second end, a bottom wall opposite the top wall between the first end and the second end, and side walls between the top wall and the bottom wall. The enclosure includes a first passageway that receives the print medium at the first end and is sized to pass the print medium through the enclosure. The microwave coupler further includes a ramp section extending from an opening in the top wall and having a third end. The microwave coupler further includes a microwave shield disposed between the first end and the opening that extends from the top wall towards the bottom wall. The microwave source is coupled to the third end and generates electromagnetic energy to dry the wet colorant applied to the print medium. The microwave waveguide is coupled to the second end and transports the electromagnetic energy received from the microwave coupler. The microwave waveguide includes a second passageway that receives the medium from the first passageway and is sized to pass the medium through the microwave waveguide.

The features, functions, and advantages that have been discussed can be achieved independently in various embodiments or may be combined in yet other embodiments, further details of which can be seen with reference to the following description and drawings.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific illustrative embodiments. It will be appreciated that those skilled in the art will be able to devise various arrangements that, although not explicitly described or shown herein, embody the principles described herein and are included within the contemplated scope of the claims that follow this description. Furthermore, any examples described herein are intended to aid in understanding the principles of the disclosure, and are to be construed as being without limitation. As a result, this disclosure is not limited to the specific embodiments or examples described below, but by the claims and their equivalents.

Figure 1A:
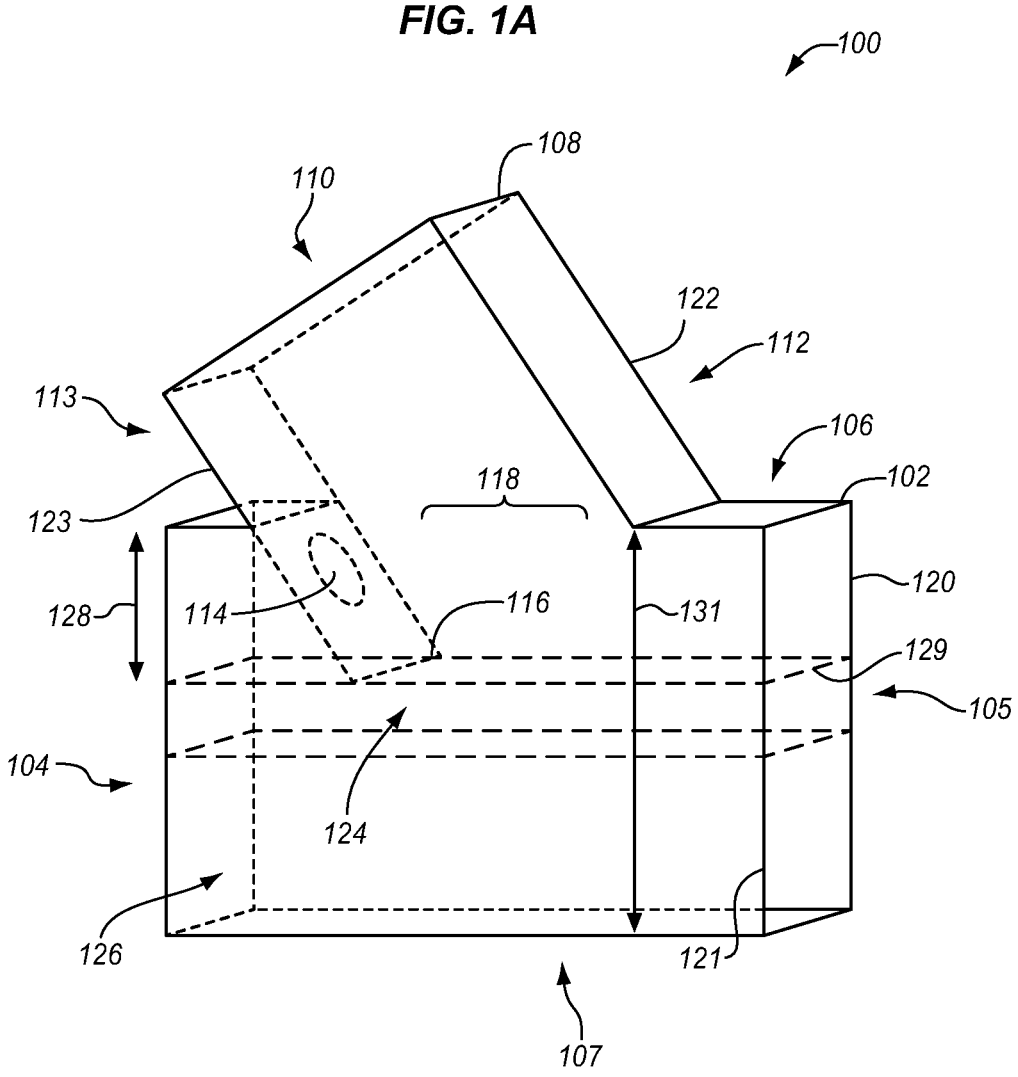
FIG. 1A is a perspective view of a microwave coupler in an illustrative embodiment.

FIG. 1A is a perspective view of a microwave coupler 100 in an illustrative embodiment. Microwave coupler 100 is used to couple a microwave source (not shown in this view) to a microwave waveguide (not shown in this view) to provide microwave drying capabilities. In this embodiment, microwave coupler 100 includes an enclosure 102 having a ramp section 108 that extends from an opening 118 in a top wall 106 of enclosure 102. Ramp section 108 is configured to direct microwave energy into an interior 126 of enclosure 102 through opening 118 in top wall 106 of enclosure 102. When microwave coupler 100 is attached to a microwave waveguide, the microwave energy directed into interior 126 of enclosure 102 is directed through the microwave waveguide.

Enclosure 102 in this embodiment has a first end 104, an opposing second end 105, and side walls 120-121. In FIG. 1A, first end 104 is illustrated on the left of enclosure 102, and second end 105 is illustrated on the right of enclosure 102. Second end 105 of enclosure 102 is configured to mate to a microwave waveguide. When microwave coupler 100 is mated to a microwave source (not shown) at a third end 110 of ramp section 108, microwave energy is directed through ramp section 108 into interior 126 of enclosure 102, via opening 118 in top wall 106 of enclosure 102.

In addition to top wall 106, which is disposed between ends 104-105 of enclosure 102, enclosure 102 also includes a bottom wall 107 that is opposite top wall 106. Bottom wall 107 is also disposed between ends 104-105. In some embodiments, enclosure 102 includes a passageway 124 between ends 104-105 that is sized to allow a medium (e.g., a print medium) to pass through microwave coupler 100. In further embodiments, passageway 124 is centered along a distance 131.

In this embodiment, ramp section 108 has an upper ramp 112 disposed towards second end 105 of enclosure 102, and a lower ramp 113 disposed toward first end 104 of enclosure 102. Ramp section 108 also includes side walls 122-123 between lower ramp 113 and upper ramp 112.

In this embodiment, ramp section 108 of microwave coupler 100 includes a microwave shield 116. Microwave shield 116 is disposed between first end 104 of enclosure 102 and opening 118 through top wall 106 of enclosure 102, and is generally configured to reduce RF energy emissions from first end 104 of enclosure 102. For example, microwave shield 116 may extend a distance 128 between ½ and ¼ of a distance 131 between top wall 106 and bottom wall 107. More specifically, distance 128 is selected such that microwave shield 116 does not obstruct passageway 124, if passageway 124 is present. In one embodiment, microwave shield 116 extends from opening 118 to an edge plane 129 of passageway 124.

Although FIG. 1A illustrates microwave shield 116 extending into interior 126 of enclosure 102 along the same plane as lower ramp 113, other embodiments may have microwave shield 116 extending into interior 126 of enclosure 102 at a different angle (e.g., vertically extending from top wall 106 towards bottom wall 107). In some embodiments, microwave shield 116 may include a vent 114 that allows an airflow through microwave shield 116.

Figure 1B:
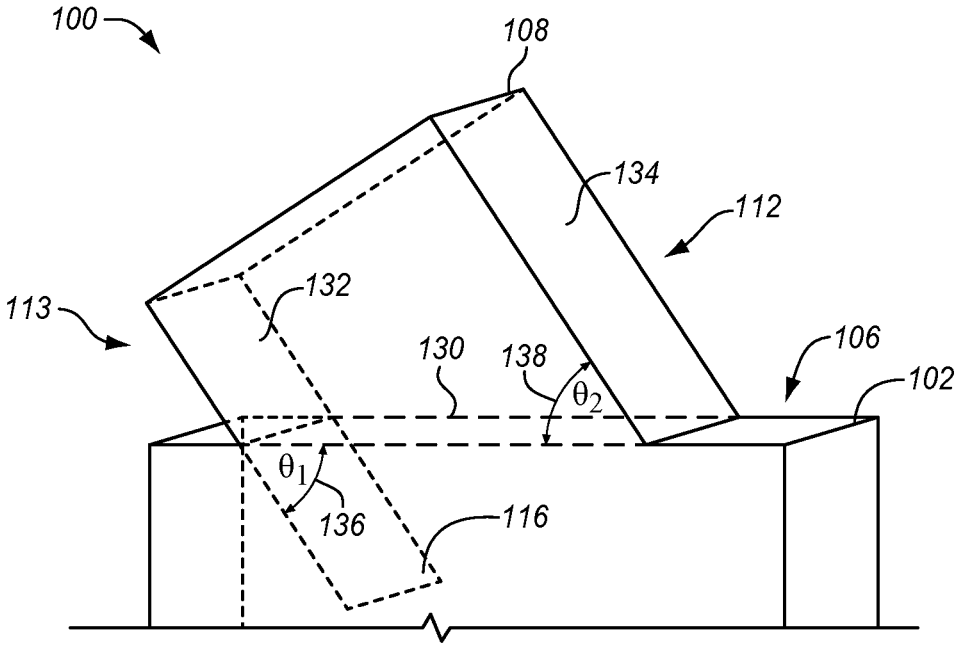
FIG. 1B is a magnified view of the microwave coupler of FIG. 1A in an illustrative embodiment.

FIG. 1B illustrates a magnified view of microwave coupler 100 in an illustrative embodiment. In FIG. 1B, microwave shield 116 extends along a plane 132 of lower ramp 113, and forms an angle 136 (θ1) with a plane 130 of top wall 106. Although angle 136 (θ1) may be varied as desired, one particular embodiment has angle 136 (θ1) at 45 degrees and another embodiment has angle 136 (θ1) between 30 and 55 degrees. 45 degrees may be ideally selected to improve the transmission of microwave energy from ramp section 108 into enclosure 102.

In some embodiments, ramp section 108 may extend from top wall 106 at an angle 138 (θ2) of 45 degrees. In other embodiments, ramp section 108 may extend from top wall 106 at an angle 138 (θ2) of between 30 and 55 degrees. In this case, a plane 134 of upper ramp 112 forms angle 138 (θ2) with plane 130 of top wall 106. When angle 136 (θ1) and angle 138 (θ2) are the same, then plane 132 of lower ramp 113 is parallel with plane 134 of upper ramp 112.

Figure 1C:
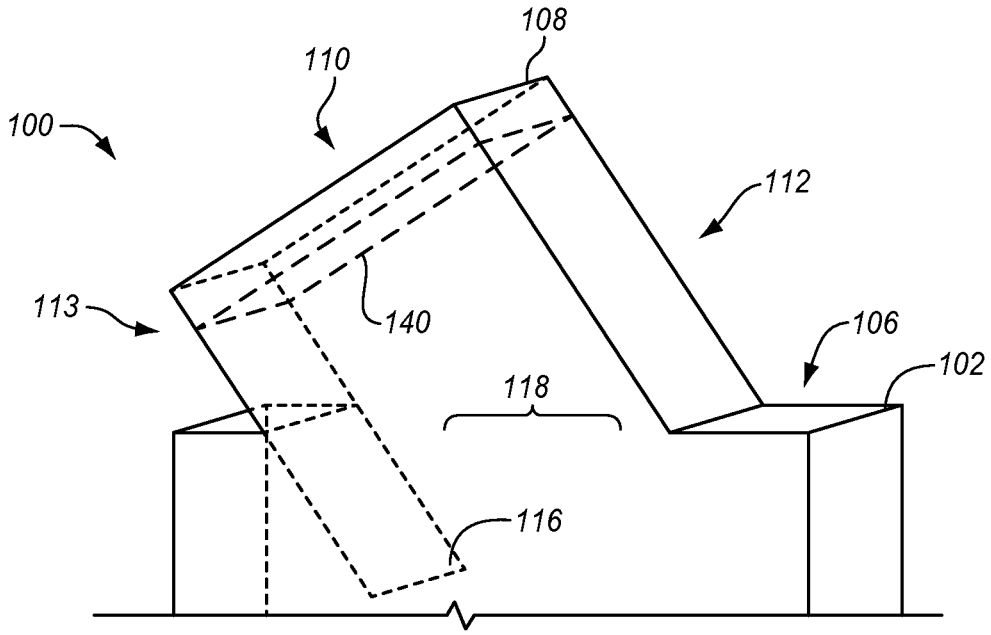
FIG. 1C is another magnified view of the microwave coupler of FIG. 1A in another illustrative embodiment.

FIG. 1C illustrates another magnified view of microwave coupler 100 in an illustrative embodiment. In some embodiments, a ramp section 108 may include a microwave transparent material 140 that isolates third end 110 from opening 118. Microwave transparent material 140 may be used to prevent dust from entering a microwave source (not shown) attached to third end 110 from enclosure 102 by providing a physical barrier to dust or air. As used herein, materials are transparent to microwave radiation if they exhibit a low index of refraction or low dielectric permittivity (e.g., between 2 and 4, such as 3) for microwave radiation between 2 and 3 GHz (e.g., 2.45 GHz). Materials may also be considered transparent to microwave radiation if they allow more than fifty percent (e.g., seventy five percent) transmission of microwave radiation between 2 and 3 GHz (e.g., 2.45 GHz). Microwave transparent material 140 may comprise fused quartz, fused silica, another type of glass, Styrofoam, etc.

Figure 2:
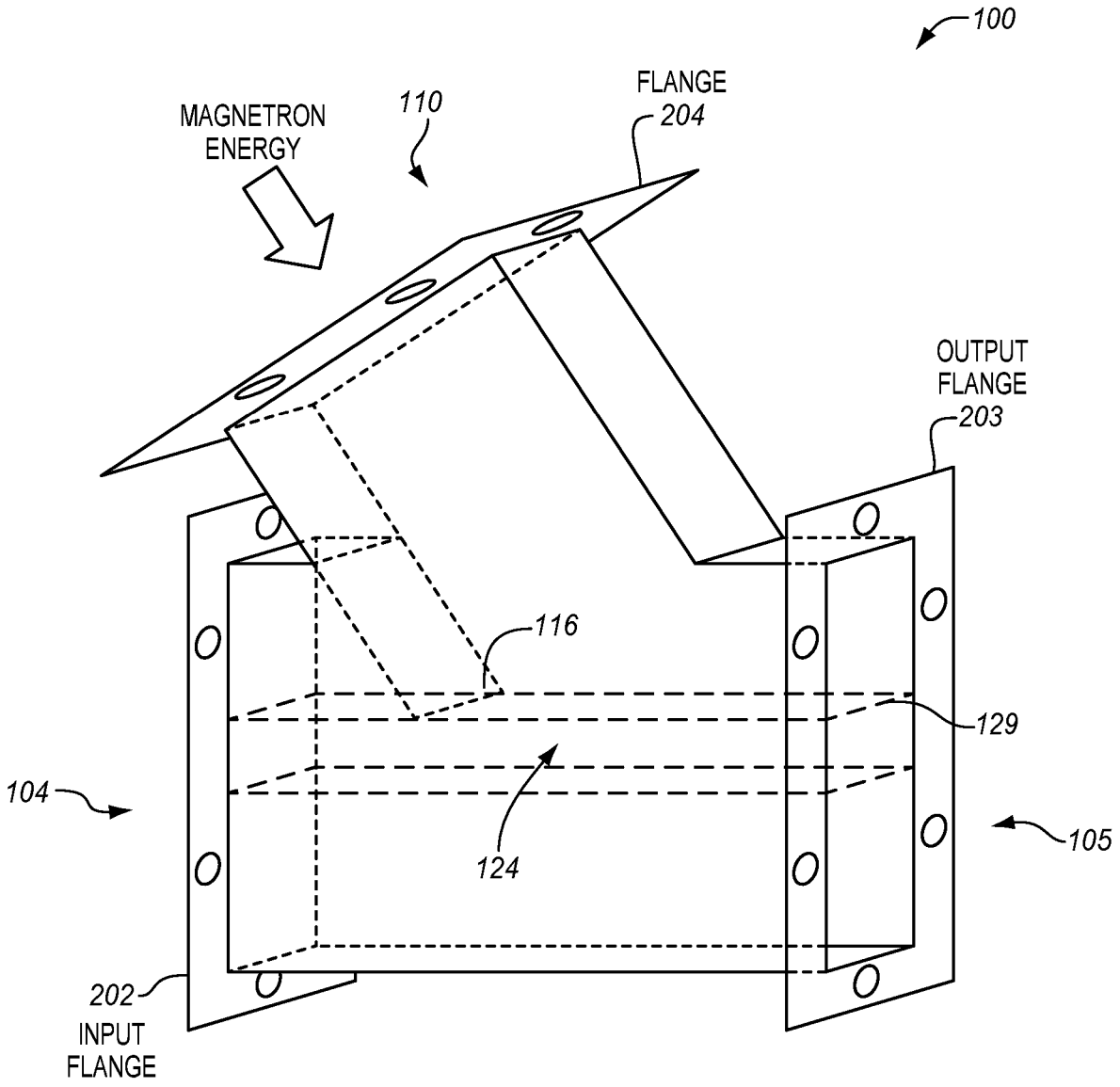
FIG. 2 is a perspective view of the microwave coupler of FIG. 1A in another illustrative embodiment.

FIG. 2 is a perspective view of microwave coupler 100 in another illustrative embodiment. In this embodiment, microwave coupler 100 includes an input flange 202 coupled to first end 104, an output flange 203 coupled to second end 105, and a flange 204 coupled to third end 110. Output flange 203 may be used to allow microwave coupler 100 to be attached to a waveguide (not shown), while flange 204 may be used to allow microwave coupler 100 to be attached to a magnetron (not shown).

Figure 3:
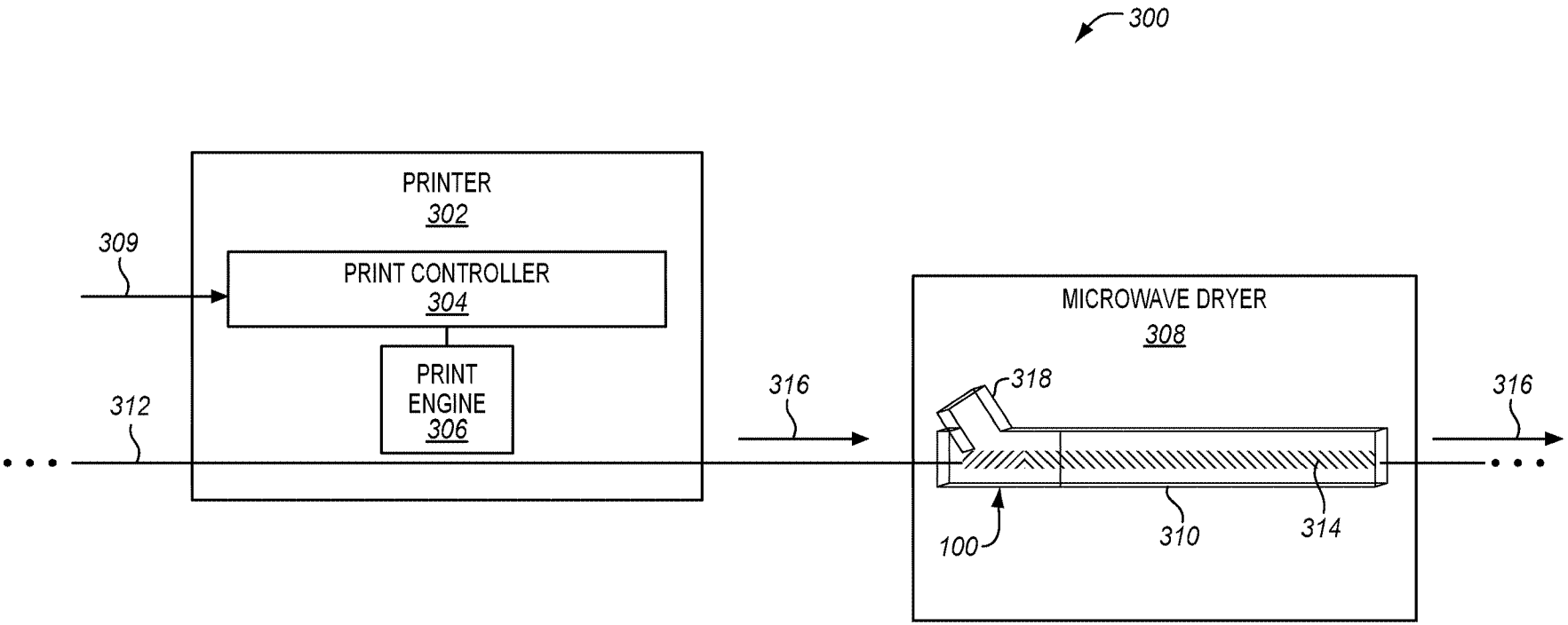
FIG. 3 is a block diagram of a printing system in an illustrative embodiment.

FIG. 3 is a block diagram of a printing system 300 in an illustrative embodiment. FIG. 3 also illustrates a print medium 312 (e.g., a continuous-form print medium) that is marked by printing system 300 with a wet or liquid colorant. Some examples of wet or liquid colorants include aqueous inks. Some examples of print medium 312 include paper, textile, and other printable planar materials. Print medium 312 travels along a media path 316 in FIG. 3.

In this embodiment, printing system 300 includes a printer 302 and a microwave dryer 308. Printer 302 applies a wet colorant to print medium 312 (e.g., a continuous-form or cut-sheet media), which is then dried by microwave dryer 308. In printing system 300, a print controller 304 of printer 302 receives print data 309 for imprinting onto print medium 312, which is rasterized by print controller 304 into bitmap data. The bitmap data is used by a print engine 306 (e.g., a drop-on-demand ink jet print engine) of printer 302 to apply wet colorants to print medium 312, which then travels downstream of printer 302 to microwave dryer 308. Microwave coupler 100 and a waveguide 310 attached to microwave coupler 100 apply electromagnetic energy 314 (e.g., microwave energy from a microwave source 318 (e.g., a magnetron)) to print medium 312, which heats the wet colorants applied to print medium 312 by electromagnetic heating (i.e., dielectric heating) to evaporate a liquid portion of the wet colorants. This fixes the wet colorants to print medium 312. Although printer 302 and microwave dryer 308 are illustrated as separate elements in FIG. 3, printer 302 and microwave dryer 308 may be combined together in some embodiments.

In printing system 300, microwave dryer 308 utilizes microwave shield 116 (see FIG. 1A) of microwave coupler 100 to reduce an RF leakage of electromagnetic energy 314 from microwave dryer 308. This is particularly helpful when microwave coupler 100 includes passageway 124, which allows print medium 312 to pass through microwave coupler 100 and waveguide 310.

Figure 4A:
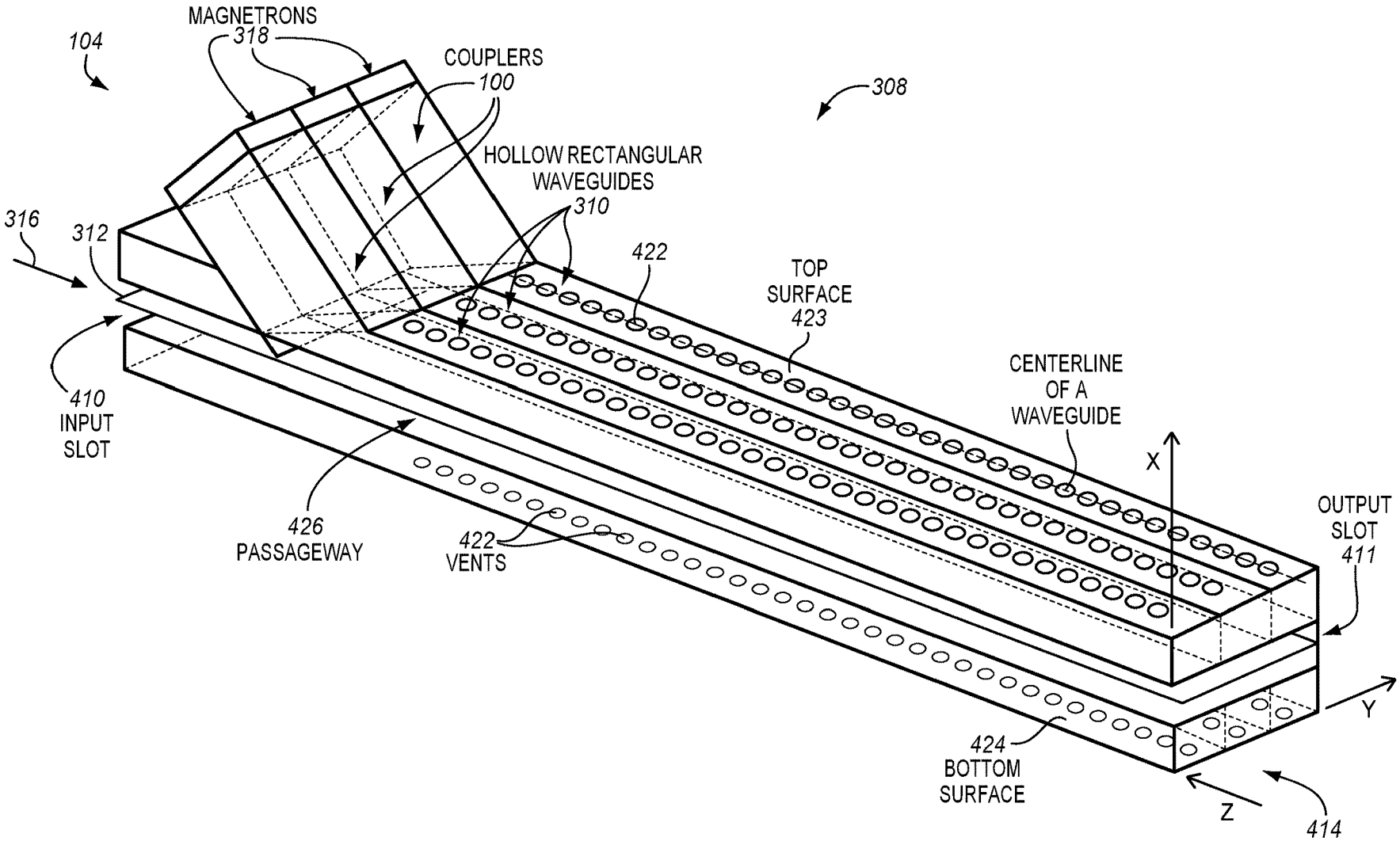
FIG. 4A is a perspective view of a cross-section of a microwave dryer in an illustrative embodiment.

FIG. 4A is a perspective view of a cross-section of microwave dryer 308 in an illustrative embodiment. In this embodiment, microwave dryer 308 includes a plurality of microwave waveguides 310 that are electromagnetically coupled to microwave sources 318 (e.g., a 2.4 Gigahertz microwave sources) via microwave couplers 100. Although waveguides 310 are illustrated in a horizontal configuration in FIG. 4A, waveguides 310 may be oriented vertically within microwave dryer 308 to further reduce a horizontal footprint of microwave dryer 308. In this embodiment, microwave sources 318 inject electromagnetic energy 314 into waveguides 310, which heats the wet colorants applied to print medium 312 while print medium 312 is within waveguides 310. As shown, a plurality of waveguides 310 are positioned adjacent to each other lengthwise. Waveguides 310 on the ends across the width of print medium 312 are not shown in FIG. 4A for illustrative purposes.

Figure 4B:
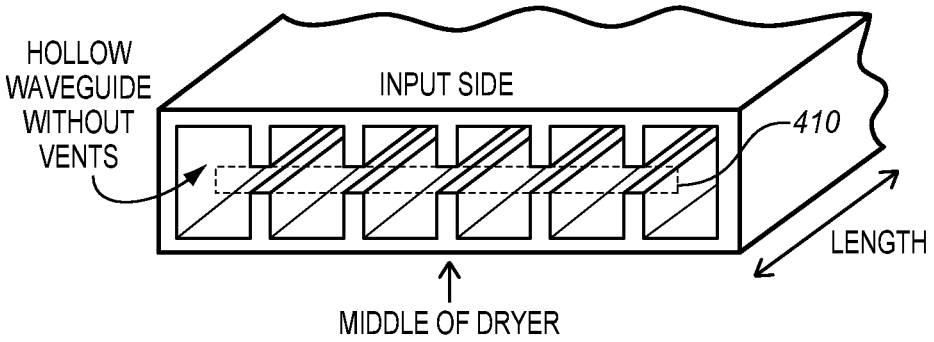
FIG. 4B is an end view of the microwave dryer of FIG. 4A in an illustrative embodiment.
Figure 4C:
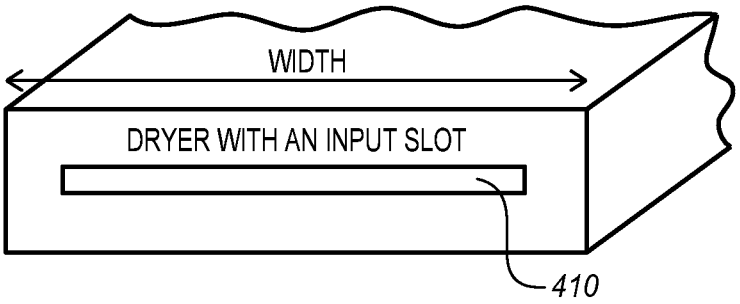
FIG. 4C is another end view of the microwave dryer of FIG. 4A in an illustrative embodiment.

In this embodiment, an input slot 410 at a first end 104 of microwave coupler 100 is sized to accept print medium 312, and to pass print medium 312 into waveguides 310. For example, input slot 410 may be sized to have about same width as print medium 312, and a height selected based on the frequency of electromagnetic energy 314. When microwave source 318 operates at 2.4 Gigahertz, input slot 410 may have a height that is about 1 to 1.5 centimeters. In this embodiment, an output slot 411 at a second end 414 of waveguides 310 is sized to accept print medium 312, and to pass print medium 312 out of waveguides 310. A passageway 426 extends through waveguides 310 and is aligned with passageway 124 of microwave coupler 100. Passageway 426 and passageway 124 are sized to accept print medium 312, and to allow print medium 312 to traverse through microwave dryer 308 and at least one of waveguides 310. The number of waveguides 310 is selected to accommodate a width of passageway 426 such that the outer side walls of microwave dryer 308 do not include passageway 426. The number of microwave couplers 100 in microwave dryer 308 is selected to match the number of waveguides 310. In embodiments with more than one microwave couplers 100, passageway 124 pass through one or more microwave couplers 100. FIG. 4B and FIG. 4C are end views of microwave dryer 308 of FIG. 4A in an illustrative embodiment, and illustrate input slot 410. FIG. 4B illustrates waveguides 310 located on the ends across the width of print medium 312.

In some embodiments, waveguides 310 may include vents 422 in a top surface 423 and bottom surface 424 of waveguides 310, which can be used to provide airflow through the interiors of waveguides 310.

Figure 5:
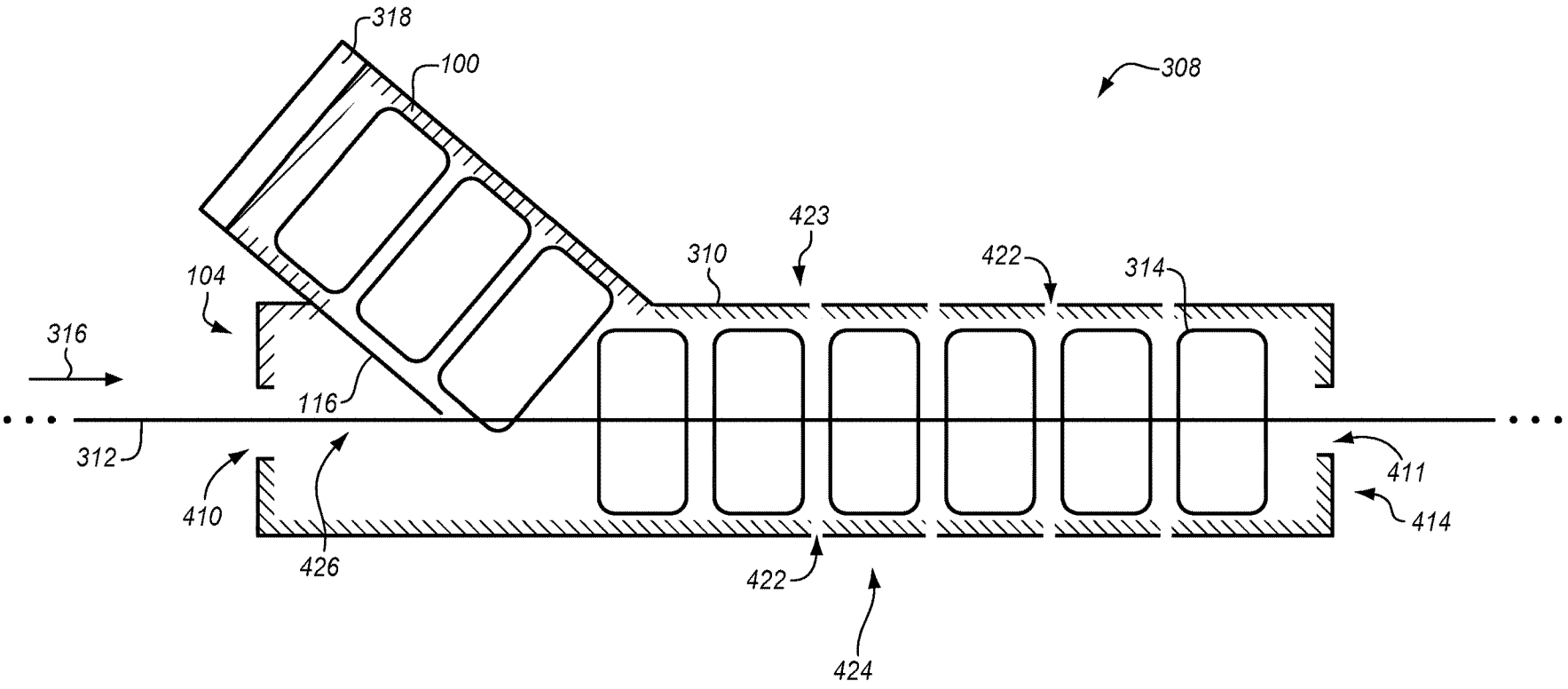
FIG. 5 is a cross-section of one of the waveguides of the microwave dryer of FIG. 4A in an illustrative embodiment.

FIG. 5 is a cross-section of one of the waveguides 310 of FIG. 4A and a microwave coupler 100 in an illustrative embodiment. Print medium 312 is received by microwave dryer 308 at input slot 410 of microwave coupler 100, where print medium 312 travels along media path 316 past microwave shield 116 and through passageway 426 to output slot 411. Electromagnetic energy 314 is generated by microwave source 318, which travels through microwave coupler 100 and into waveguide 310. Electromagnetic energy 314 shows the approximate outline of areas of higher energy strength. Microwave shield 116 prevents electromagnetic energy 314 from leaking from input slot 410, which improves the efficiency of microwave dryer 308.

Figure 6:
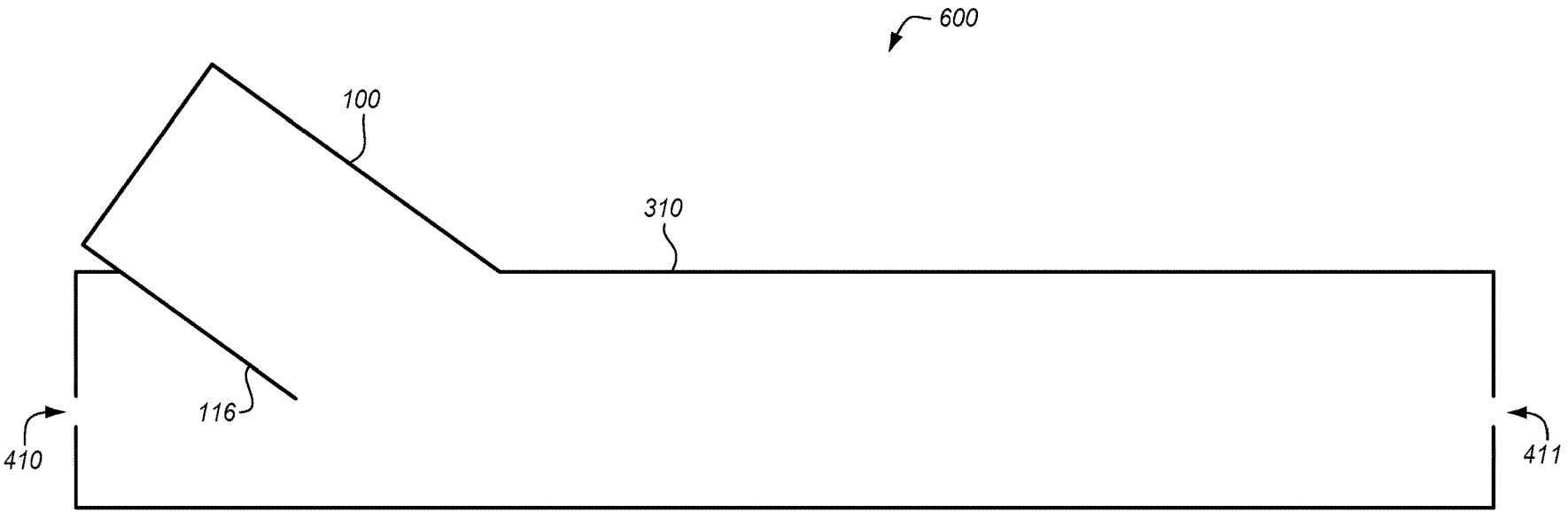
FIG. 6 is a cross-section of an RF model of a microwave coupler and waveguide in an illustrative embodiment.
Figure 7:
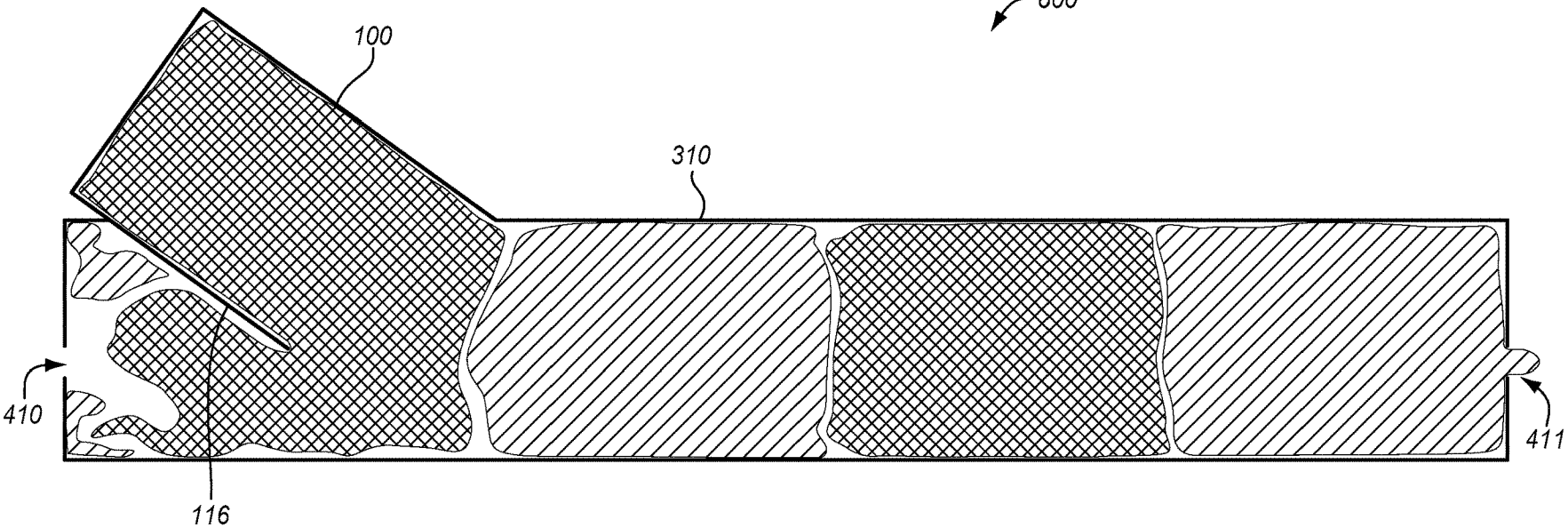
FIG. 7 illustrates the experimental results of an analysis of the RF model of the microwave coupler of FIG. 6 in an illustrative embodiment.

FIG. 6 illustrates an RF model 600 of one combination of microwave coupler 100 and waveguide 310 in an illustrative embodiment. RF model 600 is a simplified model that will be used to illustrate how microwave shield 116 mitigates the RF leakage from input slot 410. FIG. 7 illustrates the result of an RF analysis of RF model 600 in operation. In this analysis, microwave shield 116 reduced the RF leakage from input slot 410 and increased the RF energy strength at the output slot 411. The RF energy strength within the model is shown with cross-hatched areas indicating locations of higher energy strength and areas with or without lines indicating locations with lower energy strength.

The use of microwave shield 116 for microwave coupler 100 improves the efficiency of microwave dryer 308 by reducing a RF leakage of electromagnetic energy 314 from microwave coupler 100. While the leaked energy may heat the material, this leakage makes the dryer less efficient because the leaked energy cannot reinforce the existing RF energy that resides within the dryer. Coupler 100 enables a reflection of the propagating electromagnetic energy 314 back into dryer 308 to reinforce the existing electromagnetic energy 314 between coupler 100 and second end 414 of waveguides 310. In addition to the attenuation of the electromagnetic energy 314 residing within passageway 426 where the material (e.g., print medium 312) enters dryer 308, coupler 100 itself produces a primary reflection of the propagating electromagnetic energy 314 within dryer 308 that hinders the leakage of the electromagnetic energy 314 at the location where the material enters passageway 426 (e.g., input slot 410).

Although specific embodiments were described herein, the scope of the invention is not limited to those specific embodiments. The scope of the invention is defined by the following claims and any equivalents thereof.

What is claimed is:

1. A microwave coupler configured to couple a microwave source to a microwave waveguide, the microwave coupler, comprising:

an enclosure that includes a first end, a second end opposite the first end that is configured to mate to the microwave waveguide, a top wall between the first end and the second end, a bottom wall opposite the top wall between the first end and the second end, side walls between the top wall and the bottom wall, and an interior defined by the first end, the second end, the top wall, the bottom wall, and the side walls;

a ramp section extending from an opening in the top wall and having a third end that is configured to mate to the microwave source, wherein the ramp section includes a lower ramp disposed towards the first end, an upper ramp opposite the lower ramp that is disposed towards the second end, and side walls between the lower ramp and the upper ramp, wherein the ramp section is configured to direct microwave energy from the microwave source into the interior of the enclosure through the opening, wherein the interior of the enclosure is configured to direct the microwave energy from the microwave source to exit the microwave coupler through the second end and into the microwave waveguide; and a microwave shield disposed between the first end and the opening that extends from the lower ramp and the top wall towards the bottom wall, wherein the microwave shield is coplanar with the lower ramp.

2. The microwave coupler of claim 1, wherein:

the microwave shield extends from the top wall towards the bottom wall, and has a length of between ¼ and ½ of a total distance between the top wall and the bottom wall.

3. The microwave coupler of claim 1, wherein:

the ramp section extends from the top wall at an angle of between 35 and 55 degrees with respect to a plane of the top wall.

4. The microwave coupler of claim 1, wherein:

the lower ramp and the microwave shield extend toward the bottom wall at an angle of between 35 and 55 degrees with respect to a plane of the top wall.

5. The microwave coupler of claim 1, further comprising:

a passageway that receives a medium at the first end and is sized to pass the medium through the enclosure to the microwave waveguide at the second end.

6. The microwave coupler of claim 1, wherein:

the ramp section includes a microwave transparent material that isolates the third end from the opening in the top wall of the enclosure.

7. A microwave dryer configured to fix a material applied to a medium, the microwave dryer comprising:

a microwave source that is configured to generate electromagnetic energy to fix the material to the medium;

a microwave waveguide; and a microwave coupler coupling the microwave source to the microwave waveguide, the microwave coupler including:

an enclosure that includes a first end, a second end opposite the first end that is coupled to the microwave waveguide, a top wall between the first end and the second end, a bottom wall opposite the top wall between the first end and the second end, side walls between the top wall and the bottom wall, and an interior defined by the first end, the second end, the top wall, the bottom wall, and the side walls, wherein the enclosure includes a first passageway that receives the medium at the first end and is sized to pass the medium through the interior of the enclosure to the microwave waveguide at the second end;

a ramp section extending from an opening in the top wall and having a third end coupled to the microwave source, wherein the ramp section includes a lower ramp disposed towards the first end, an upper ramp opposite the lower ramp that is disposed towards the second end, and side walls between the lower ramp and the upper ramp, wherein the ramp section is configured to direct the electromagnetic energy from the microwave source into the interior of the enclosure through the opening, wherein the interior of the enclosure is configured to direct the electromagnetic energy from the microwave source to exit the microwave coupler through the second end and into the microwave waveguide; and a microwave shield disposed between the first end and the opening that extends from the lower ramp and the top wall towards the bottom wall, wherein the microwave shield is coplanar with the lower ramp, wherein the microwave waveguide is configured to transport the electromagnetic energy received from the second end of the enclosure, wherein the microwave waveguide includes a second passageway that receives the medium from the first passageway and is sized to pass the medium through the microwave waveguide.

8. The microwave dryer of claim 7, wherein:

the microwave shield extends from the top wall towards the bottom wall, and has a length of between ¼ and ½ of a total distance between the top wall and the bottom wall.

9. The microwave dryer of claim 7, wherein:

the ramp section extends from the top wall at an angle of between 30 and 50 degrees with respect to a plane of the top wall.

10. The microwave dryer of claim 7, wherein:

the lower ramp and the microwave shield extend toward the bottom wall at an angle of 45 degrees with respect to a plane of the top wall.

11. The microwave dryer of claim 7, wherein:

the ramp section includes a microwave transparent material that isolates an interior of the ramp section from the opening in the top wall of the enclosure.

12. The microwave dryer of claim 7, wherein:

the medium comprises a print medium; and the material comprises a wet colorant applied to the print medium.

13. A printing system, comprising:

a print engine configured to apply a wet colorant to a print medium; and a microwave dryer configured to receive the print medium from the print engine, and to dry the wet colorant applied to the print medium, the microwave dryer comprising:

a microwave source that is configured to generate electromagnetic energy to dry the wet colorant applied to the print medium;

a microwave waveguide; and a microwave coupler coupling the microwave source to the microwave waveguide, the microwave coupler including:

an enclosure that includes a first end, a second end opposite the first end that is coupled to the microwave waveguide, a top wall between the first end and the second end, a bottom wall opposite the top wall between the first end and the second end, side walls between the top wall and the bottom wall, and an interior defined by the first end, the second end, the top wall, the bottom wall, and the side walls, wherein the enclosure includes a first passageway that receives the print medium at the first end and is sized to pass the print medium through the interior of the enclosure to the microwave waveguide at the second end;

a ramp section extending from an opening in the top wall and having a third end coupled to the microwave source, wherein the ramp section includes a lower ramp disposed towards the first end, an upper ramp opposite the lower ramp that is disposed towards the second end, and side walls between the lower ramp and the upper ramp, wherein the ramp section is configured to direct the electromagnetic energy from the microwave source into the interior of the enclosure through the opening, wherein the interior of the enclosure is configured to direct the electromagnetic energy from the microwave source to exit the microwave coupler through the second end and into the microwave waveguide; and a microwave shield disposed between the first end and the opening that extends from the lower ramp and the top wall towards the bottom wall, wherein the microwave shield is coplanar with the lower ramp, wherein the microwave waveguide is configured to transport the electromagnetic energy received from the second end of the microwave coupler, wherein the microwave waveguide includes a second passageway that receives the print medium from the first passageway and is sized to pass the print medium through the microwave waveguide.

14. The printing system of claim 13, wherein:

the microwave shield extends from the top wall towards the bottom wall, and has a length of between ¼ and ½ of a total distance between the top wall and the bottom wall.

15. The printing system of claim 13, wherein:

the ramp section extends from the top wall at an angle of between 35 and 55 degrees with respect to a plane of the top wall.

16. The printing system of claim 13, wherein:

the lower ramp and the microwave shield extend toward the bottom wall at an angle of between 35 and 55 degrees with respect to a plane of the top wall.

17. The printing system of claim 13, wherein:

the ramp section includes a microwave transparent material that isolates an interior of the ramp section from the opening in the top wall of the enclosure.

* * * * *